US006362156B1

(12) United States Patent
Hsu et al.

(10) Patent No.: US 6,362,156 B1
(45) **Date of Patent: *Mar. 26, 2002**

(54) POURABLE TRANSPARENT/TRANSLUCENT LIQUID DETERGENT COMPOSITION WITH SUSPENDED PARTICLES

(75) Inventors: Feng-Lung Gordon Hsu, Tenafly; Dennis Stephen Murphy, Leonia; Kristina Marie Neuser, Cliffside Park; Myongsuk Bae-Lee, Montville; Daniel Joseph Kuzmenka, Wood-Ridge; Kim Garufi, Cliffside Park, all of NJ (US); Pascale Germaine Lazare, Den Haag (NL); Cornelis Johannes Buytenhek, Vlaardingen (NL); Pieter Willem Van Reeven, Vlaardingen (NL); Charles Cornelis Verburg, Vlaardingen (NL); Frank Theodor Van De Scheur, Bergschenhoek (NL)

(73) Assignee: Unilever Home & Personal Care, USA, division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/212,983

(22) Filed: Dec. 16, 1998

(51) Int. Cl.[7] ..... C11D 3/22

(52) U.S. Cl. ..... 510/418; 510/337; 510/417; 510/470; 510/471

(58) Field of Search ..... 510/121, 193, 510/417, 418, 470, 471, 472, 337

(56) References Cited

U.S. PATENT DOCUMENTS

| | | | | |
|---|---|---|---|---|
| 2,503,280 A | | 4/1950 | Lockwood | |
| 2,507,088 A | | 5/1950 | Bradley | |
| 3,060,124 A | | 10/1962 | Ginn | 510/223 |
| 3,260,741 A | | 7/1966 | Mackinnon et al. | |
| 3,308,067 A | | 3/1967 | Diehl | |
| 3,372,188 A | | 3/1968 | Alston et al. | |
| 3,630,929 A | | 12/1971 | Van Dijk | 252/363.5 |
| 4,062,647 A | | 12/1977 | Storm et al. | 510/334 |
| 4,090,973 A | | 5/1978 | Maguire, Jr. et al. | 427/212 |
| 4,260,528 A | | 4/1981 | Fox et al. | 510/221 |
| 4,316,812 A | | 2/1982 | Hancock et al. | 510/108 |
| 4,474,818 A | * | 10/1984 | Scott | 424/358 |
| 4,497,718 A | | 2/1985 | Neiditch et al. | |
| 4,556,510 A | | 12/1985 | Holsopple | 510/427 |
| 4,581,042 A | | 4/1986 | Willmore | 51/293 |
| 4,749,512 A | | 6/1988 | Brose et al. | 252/186.38 |
| 5,047,167 A | | 9/1991 | Steyn et al. | 510/223 |
| 5,057,241 A | | 10/1991 | Merritt et al. | 510/119 |
| 5,147,576 A | | 9/1992 | Montague et al. | 510/321 |
| 5,281,355 A | | 1/1994 | Tsaur et al. | 510/321 |
| 5,281,356 A | | 1/1994 | Tsaur et al. | 510/321 |
| 5,393,450 A | | 2/1995 | Shana'a | 510/403 |
| 5,494,602 A | | 2/1996 | Thomaides et al. | 510/339 |
| 5,534,265 A | * | 7/1996 | Fowler et al. | 424/489 |
| 5,562,939 A | | 10/1996 | Lewis | 426/573 |
| 5,589,370 A | | 12/1996 | Ratuiste et al. | 252/79.1 |
| 5,597,790 A | | 1/1997 | Thoen | 252/186.27 |
| 5,733,854 A | * | 3/1998 | Chowdhary et al. | 510/121 |
| 5,750,489 A | | 5/1998 | Garcia et al. | 510/303 |
| 5,853,430 A | * | 12/1998 | Shindo et al. | 8/137 |
| 5,880,076 A | * | 3/1999 | Vermeer | 510/123 |
| 5,972,877 A | | 10/1999 | Tsuda et al. | 510/426 |

FOREIGN PATENT DOCUMENTS

| | | |
|---|---|---|
| EP | 100 125 | 2/1984 |
| EP | 0 170 927 | 2/1986 |
| EP | 258068 | 3/1988 |
| EP | 763 595 | 3/1997 |
| GB | 401413 | 11/1933 |
| GB | 461221 | 2/1937 |
| GB | 1303810 | 1/1973 |
| GB | 1429143 | 3/1976 |
| GB | 1461755 | 1/1977 |
| GB | 1470250 | 4/1977 |
| NL | 154269 | 8/1977 |
| WO | 95/31528 | 11/1995 |
| WO | 97/26315 | 7/1997 |

OTHER PUBLICATIONS

PCT International Search Report in a PCT application PCT/EP 99/08894.
Derwent Abstract JP 8048999, published Feb. 20, 1996.

* cited by examiner

*Primary Examiner*—Cynthia H. Kelly
*Assistant Examiner*—Dawn Garrett
(74) *Attorney, Agent, or Firm*—Rimma Mitelman

(57) ABSTRACT

A translucent/transparent composition capable of suspending relatively large size particles while remaining readily pourable. The composition is stable, even in presence of readily large amount of electrolyte/surfactant.

25 Claims, No Drawings

POURABLE TRANSPARENT/TRANSLUCENT LIQUID DETERGENT COMPOSITION WITH SUSPENDED PARTICLES

BACKGROUND OF THE INVENTION

1. Field of the Invention

The present invention relates to transparent or translucent heavy duty liquid laundry detergent compositions containing polymers (e.g., gums) capable of suspending relatively large size particles (e.g., capsules) while at the same time remaining readily pourable. The suspended particles generally comprise a component subject to degradation (e.g., encapsulated enzymes or bleach) and/or a component not soluble in the heavy duty liquid and which causes an opaque appearance. Through careful selection of polymer/polymers, it is possible to find a polymer suspending system (i.e., a continuous or non-continuous polymer network) which is stable in an ionic (e.g., high surfactant or high electrolyte concentration) environment and which simultaneously provides consumer desirable appearance.

2. Background

For a variety of reasons, it is often greatly desirable to suspend particles in heavy duty liquid detergent compositions. For example, because there are certain components (e.g., bleaches, enzymes, perfumes) which readily degrade in the hostile environment of surfactant containing heavy duty liquids, these components can be protected in capsule particles (such as described, for example, in U.S. Pat. Nos. 5,281,355 and 5,281,356 to Tsaur et al., hereby incorporated by reference into the subject application) and the capsule particles may be suspended in the heavy duty liquid detergents. Other particles which may be suspended include enzymes (whether or not encapsulated) and desirable ingredients (e.g., polyvinylpyrrolidone, aminosilicones, soil release agents, antiredepositon agents, antiwrinkle agents, etc.)

One way to suspend particles in liquid compositions is to use so-called "structured" heavy duty liquids (sometimes referred to in the art as "duotropic" liquids and in contrast to single continuous phase "isotropic" liquids). Structured liquids may be broadly characterized in that they contain high levels of electrolyte and in that the liquids form so-called lamellar layers which are like sheets or plates in close proximity to one other. Structured liquids are well defined in U.S. Pat. No. 5,147,576 to Montague et al., hereby incorporated by reference into the subject application. Such structured liquids, by virtue of their close packing and lamellar sheets, are generally able to suspend particles (e.g., capsules, enzymes, polymers) more readily than isotropic liquids. Structured liquids are often difficult to pour and, because they are lamellar, are generally if not always opaque.

Another way of suspending particles in liquids is through the use of certain structuring gums (e.g., xanthan gum, rhamsan gum and the like). While such gums are desirably used to structure liquids and suspend particles, however, they are notoriously susceptible to electrolytes (e.g., surfactants, electrolyte) present in the compositions and so may generally only be used when the level of surfactant is severely limited (e.g., less than 10% by wt.). By contrast, compositions of the present invention comprise greater than 15%, preferably greater than 17% most preferably 20–85% by wt. surfactant and/or electrolyte. Use of gums and such high levels of surfactant is known to lead to instability/precipitation which in turn leads to non-clear product and to phase separation.

Moreover, when used to thicken compositions, the gum polymers are generally used in such high amounts as to render the compositions very difficult to pour. By difficult to pour is meant greater than about 3000 cps at $21S^{-1}$ shear rate measured at room temperature (measurements of invention were made using Haake RV20 Rotovisco RC20 Rheocontroller; preferred sensor systems were MV1, MV2 and MV3 sensor systems).

As far as applicants are aware, all attempts to suspend particles, particularly large size particles (e.g., greater than 300 to 5000 microns, preferably 500 or greater to 3000 microns) in liquid compositions (preferably isotropic compositions), particularly those containing greater than 15% surfactant, while maintaining pourability have been unsuccessful. In particular, attempts to suspend particles in pourable liquids in a translucent/transparent composition is simply unknown.

U.S. Pat. No. 4,749,512 to Brown et al., for example, teaches suspension of builder salts in automatic dishwashing formulations. The compositions are neither translucent nor transparent. The compositions also contain no water and no polymeric thickeners. The builders are suspended due to surfactant structuring.

U.S. Pat. No. 5,562,939 to Lewis teaches a method using a pre-gel process to suspend particles in liquid. The compositions have no surfactant and a pH of 2.5 to 6, preferably 3.0 compared to much higher surfactant levels (minimum 15% preferably greater 20% by wt.) and pH (about 6 to 13, preferably 8 to 10) of the subject invention.

U.S. Pat. No. 5,597,790 to Thoen teaches suspension of solid peroxygen compounds having particle size of 0.5 to 20 microns in liquid detergents using low levels of silicate. The suspended particles were much smaller than those of the invention.

In "Xanthan Gum: Natural Biogum for Scientific Water Control", $5^{th}$ Edition, it is taught that biological polymer solutions (e.g., xanthan gum) may be stable up to 20% nonionic or 15% anionic surfactant alone. However, the reference clearly suggests that combinations of surfactant above 20% are unstable while surfactants of the invention may be used in much greater amounts. Further, the reference relates to formation of continuous network only.

WO 97/26315 (assigned to Colgate) discloses transparent containers with specific chromaticity defined by x and y values. It uses specific dyes so that liquid can match the color of the container.

The reference fails to teach or suggest transparent compositions having pourability and particle suspension properties of the compositions of the invention.

Finally GB 1,303,810 discloses clear liquid medium and a visually distinct component of at least 0.5 millemeter particle size. However where more than 10% surfactant is used, only clays, not gums are used to structure. Where a gum is used to structure (Keizan), no more than 10% surfactant is used.

In short, there is no teaching in the art of heavy duty liquid compositions containing 15% or greater, preferably about 20% to 85% surfactant, more preferably 21% to 75% by weight surfactant comprising suspending gum polymers stable in high surfactant environment (e.g., don't phase separate and cause opaqueness) able to suspend large size particles and simultaneously provide translucent/transparent, pourable compositions.

While not wishing to be bound by theory, it is believed these compositions can be formed only because of applicants realization that the suspending polymers (e.g., gums) must be given sufficient time or heat to swell prior to their combination with surfactant and/or electrolyte. Time and temperature are highly dependent on selection of gum but it is critical that the gum be allowed to swell. In addition, for hygienic purposes it is generally desirable to heat the gums to a temperature of about 150° F.

The swollen polymer can then be formed into "suspension bits" (e.g., a continuous interlocking network or as a series of non-continuous gum particles) in the liquid detergent formulation. In other words the swollen gum polymers can "lock" to form one large continuous network or they can be suspended independently in a non-continuous fashion. Each of these processes is dependent on gum section as is described in greater detail in applicants' copending process applications filed on same date as subject application, both of which are hereby incorporated by reference into the subject application. The polymer gum "bits" may be formed prior to combining with rest of liquid detergent formulation or they may be formed in situ.

In any event, because of these pre-swollen (e.g., swollen with water before contact with surfactant and/or electrolyte) "suspension bits", surprisingly and unexpectedly, it has been found possible to form a transparent/translucent liquid detergent system which suspends large size particles and is readily pourable. Moreover, because the suspending polymer gums are not susceptible to ionic agents and/or surfactants, they can suspend in a high surfactant and/or electrolyte environment without precipitating to form opaque compositions or phase separate. This is completely novel to the art as far as applicants are aware.

BRIEF DESCRIPTION OF THE INVENTION

The present invention provides highly shear thinning, liquid compositions which are translucent/transparent and able to suspend particles from 300 to 5000 micrometers (microns) in size, even in the presence of high surfactant concentration. The key to the invention resides in the use of specific polymer gum(s) and a process in which the polymer (s) are pre-swollen to form so-called "suspension bits" before or after adding to the rest of the liquid compositions. These "bits" are far more resistant to surfactant and/or electrolyte species in the compositions and thus can be used to suspend particles while themselves remaining stable. The present invention defines the compositions of the invention (whether gums form a continuous or non-continuous suspending network), while two companion cases filed on same data relate to the process for forming the continuous network system or non-continuous network, respectively

DETAILED DESCRIPTION OF THE INVENTION

The invention comprises an easy pouring (pour viscosity of about 100 to 5000 cps at $21S^{-1}$ measured at room temperature), transparent or translucent, heavy duty liquid compositions (preferably isotropic) wherein a polymer or mixture of polymers (i.e., gums) are used to suspend relatively large size particles. Applicants are unaware of any liquid composition (having 15% or greater, preferably 20% or greater, more preferably 21% or greater surfactant and/or electrolyte) capable of suspending such large size particles in a transparent/translucent composition while retaining good pourability and stability.

The compositions of the invention comprise:

(a) about 0.01 to 5% by wt. of polymer(s) capable of forming suspending networks (continuous or non-continuous) in presence of surfactants and/or certain ionic species in which the polymers might otherwise not be stable;

(b) 0% to 70% by wt. nonionic surfactant;

(c) 0% to 60% by wt. surfactant other than nonionic (b) selected from the group consisting of anionic, nonionic, cationic, zwitterionic/ampholytic surfactant and mixtures thereof, wherein (b) and (c) comprise 15% or greater of composition.

Compositions

The various components of this invention for heavy duty liquid (HDL) detergent compositions are set forth in greater detail below.

Suspending Polymers and Polymer Mixtures

Compositions of this invention contain a polymer or polymer mixture which are capable of suspending relatively large size particles while remaining readily pourable. Specifically, the polymer gums can either interact to form an interwoven, continuous polymer network or to form a non-continuous network of gum bits capable of surrounding and suspending particles.

It is well known that polymers which require at least some ionic and/or surfactant species to be present as a prerequisite for network formation are susceptible to destabilization by surfactant, whether formed as a continuous network or as a non-continuous network. This invention surprisingly found that a polymer or polymer mix capable of forming a network by the presence of electrolytes can be stable even in heavy duty liquid detergent compositions having high surfactant concentration (i.e., 15% to 85% by wt., preferably 20% to 80% by wt. of the composition). This is the case even when ionic surfactants are used.

The polymer or polymer mixture which is capable of forming a network will usually be of natural origin, specifically one or more polysaccharides will preferably be used. Generally, they will have molecular weight of greater than half million Daltons. However, it is possible that the polymer, or one or more polymers in a mixture of polymers, might be a chemically modified natural polymer such as a polysaccharide which has been chemically treated to provide or alter substituent groups thereon. It is also conceivable that a polymer mixture might contain a synthetic polymer together with a natural polymer. Usually however, the polymer which is used will include a polysaccharide chain of natural origin.

Examples of gums which may be used are various commercial gums which may be characterized as (1) marine plant; (2) terrestrial plants; (3) microbial polysaccharides; and (4) polysaccharide derivatives. In addition, gums may include those derived from animal sources (e.g., from skin and/or bone of animals) such as gelatin.

Examples of Marine plant gums include agar, alginates, carrageenan and furcellaran. Examples of terrestrial plant gums include guar gum, gum arabic, gum tragacenth, karaya gum, locust bean gum and pectin. Examples of microbial polysaccharides include dextran, gellan gum, rhamsan gum, welan gum and xanthan gum. Examples of polysaccharide derivatives include carboxymethylcellulose, methyl hydroxypropyl cellulose, hydroxypropyl cellulose, hydroxyethyl cellulose, propylene glycol alginate, hydroxypropyl guar and modified starters.

One polysaccharide gum which may be used, for example, is carrageenan, especially kappa carrageenan.

Kappa carrageenans are a class of polysaccharides which occur in some other red seaweed species. They are linear polysaccharides made up from alternating beta-1, 3- and alpha-1, 4-linked galactose residues. The 1,4-linked residues are the D-enantiomer and sometimes occur as the 3,6-anhydride. Many of the galactose resides are sulfated.

A number of carrageenan structures have been described and commercial materials are available which approximate to the ideal structures. However, variations between these structures occur, depending on the source of the carrageenan and the treatment of it after extraction.

A description of different carrageenan types is given in "Carrageenans" by Norman F. Stanley which is Chapter 3 of "Food Gels" edited by Peter Harris. Kappa carrageenan is sulfated on the 1, 3-linked galactose residues, but not on the 1, 4-linked resides. Iota carrageenan is sulfated on both residues. Lambda carrageenan has two sulfate groups on the 1, 4-linked residues and one sulfate group on 70% of the 1, 3-linked residues.

Other types of carrageenan may be used in mixtures with kappa. Aqueous solutions of iota carrageenan exist as reversible gels, but these are self healing. Iota carrageenan can be used to form compositions in accordance with this invention, but the compositions become lumpy during storage because of the self-healing property of iota carrageenan gels. Therefore, for this invention it is preferred to use kappa carrageenan or mixtures of kappa and iota.

Lambda carrageenan on its own in aqueous solution does not form gels because its higher charge density inhibits association between molecules and consequent structuring in liquids. However, some lambda carrageenan may be included in mixtures with kappa, or may be present as an impurity in commercial supplies of kappa or iota carrageenan.

If lambda carrageenan is included in a mixture of carrageenans, the mixture may contain a majority (more than half of the polysaccharide) of kappa or kappa and iota carrageenan with a minority proportion of lambda carrageenan.

Another polymer that is similar to kappa carrageenan is Furcellaran. It is only partially sulfated on the 1, 3-linked galactose residues.

A polymer/gum of bacterial origin which also may be used is gellan. It is the polymer of a tetrasaccharide repeat unit, containing glucose, glucurronic acid, glucose and rhamrose residues. There is some substitution with acyl groups but these are often removed during production to give a low acyl gellan. Gellans are the subject of Chapter 6 by G. R. Saunderson in "Food Gels" mentioned above.

Another possibility is to use a so-called synergistic gel which relies on the interaction of two polymer types. In general these may be formed from a polysaccharide, which is a glucomannan with sequences of mannose residue in its polymer chain, such as locust bean gum or guar gum, and a second polymer, for example, is xanthan or carrageenan.

Many of the polymers noted above, when in aqueous solution, form so-called reversible gels which melt when heated, but revert to gels when cooled. A well known example of polysaccharide forming reversible gel is agar. An aqueous solution containing a small percentage of agar is a mobile liquid when hot, but when left to cool it forms a gel with sufficient rigidity to maintain its own shape. Other naturally occurring polymers which can form reversible polymers are carregeenan, furcellaran, gellan and pectin.

The formation of gels by natural polysaccharides arises from interaction between the polymer molecules. Reversible gels generally display a melting temperature or temperature range, referred to as the gel point. This is the temperature at which, on slow heating, the gel is observed to melt as this interaction largely disappears. Thus, above the gel point, the hot solution of polymer is mobile. When it cools below its gel point, the interaction of polymer molecules enables them to form a continuous and branded network which extends throughout the sample. In contrast with the formation of a continuous, branched network, some other materials which thicken water do so through merely local, transient entanglement of molecules. A discussion of polysaccharide gels, including their range of mechanical properties, is found in "Gels and gelling" by Allan H. Clark which is Chapter 5 in Physical Chemistry of Foods, Schwartzberg and Hartel, editors; published by Marcel Dekker 1992.

The melting temperature of a gel can suitably be measured by placing a steel ball, having a diameter of approximately 1 mm, on the surface of a sample which is fully set, then raising the temperature slowly, e.g., in a programmable water bath. The gel melting point is the temperature at which the ball begins to sink through the sample. Apparatus to facilitate such determinations is available, for example a Physica AMV200 rolling viscometer from Anton Paar KG.

A reversible gel also displays a transition temperature at which, upon slow temperature increase, all ordering, be it of microscopical or macroscopical extent, has disappeared completely. This transition temperature can be measured by means of differential scanning calorimetry (DSC). The transition temperature of a reversible gel, as measured by DSC, usually approximately coincides with gel melting observable visually.

Some of the gums noted above will more readily form a continuous, interlocking suspending gum network (e.g., xanthan gum), while others (e.g., carrageenan, gellan) will more readily form a non-continuous network of "bits" surrounding and suspending any particles in the compositions which are desired to be suspended. As noted above and discussed in greater detail below, because these gums are pre-swollen before contact with surfactant and/or electrolyte, they are less susceptible to ionic species and remain stable (e.g., won't turn composition opaque or phase separate) even in presence of such ionic species.

Suspending polymers particularly useful for this application include, but are not limited to: xanthan gum (e.g. Keizan T from Monsanto Corp.), gellan gum (e.g. Kelcogel from Monsanto Corp.), rhamsan gum (e.g. K7C233 from Monsanto Corp.), carrageenan gum (e.g. Genugel X-0909 from Copenhagen Pectin Co. or RE-1297-08 from FMC), agar, and furcellaran.

In another embodiment of the invention, the polymer suspending system will comprise a polysaccharide or mixture polysaccharides as noted above in combination with cationic polymer. Suspending polymer mixtures particularly useful for this embodiment include, but are not limited to: gellan gum plus cationic guar (e.g. Jaguar C162 from Rhone-Poulenc Co.), gellan gum plus polyquaternium 10 (e.g. Ucare Polymer JR 30M from Amerchol Corp.), all at from 5:1 to 100:1 gum to cationic polymer. Suspending polymer/polymer mixtures are used in the formulation in an amount from about 0.01% to about 3% total polymer, preferably between 0.1% and 0.6% total polymer.

In addition to the gum networks, an additional thickening agent, such as a small concentration of xanthan gum can be added, particularly when it is added as an accessory structurant. Other accessory structurants which can be added are any of the polysaccharide derivative such as, for example, carboxymethyl cellulose, methyl hydropropyl cellulose etc. The thickening agent can be added at any point in the process.

The key to the invention resides not so much in the use of the polymer(s) themselves (although specific polymers which form networks are needed), but in their formation in such a way that they do not interact with specific species (i.e., surfactant or other ionic species) which normally destabilize them. If not pre-swollen (e.g., through time or heat) to form "suspension bits" either prior to adding to composition, or in situ, there will occur the types of destabilizing reactions well known in the art. It is for this reason that it is believed that the art has never been able to produce suspending systems which are translucent/transparent, a highly desirable objective of the subject invention, and which are also pourable and stable.

Detergent Active

The compositions of the invention contains one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. The surfactant must comprise at least 15% by wt. of the composition, e.g., 15% to 85%, preferably 20% to 80%, more preferably 21 to 75% of the total composition.

Nonionic Surfactant

Nonionic synthetic organic detergents which can be used with the invention, alone or in combination with other surfactants, are described below.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Other useful nonionics are represented by the commercially well-known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 23-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O—_y(Z)_x$$

wherein R is a monovalent organic radical containing from about 6 to about 30 (preferably from about 8 to about 18) carbon atoms; R' is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 18(especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol 25-9 from Shell Chemical Co.), alkyl phenol ethoxylates (e.g. Tergitol NP-9 from Union Carbide Corp.), alkylpolyglucosides (e.g. Glucapon 600CS from Henkel Corp.), polyoxyethylenated polyoxypropylene glycols (e.g. Pluronic L-65 from BASF Corp.), sorbitol esters (e.g. Emsorb 2515 from Henkel Corp.), polyoxyethylenated sorbitol esters (e.g. Emsorb 6900 from Henkel Corp.), alkanolamides (e.g. Alkamide DC212/SE from Rhone-Poulenc Co.), and N-alkypyrrolidones (e.g. Surfadone LP-100 from ISP Technologies Inc.).

Nonionic surfactant is used in the formulation from about 0% to about 70%, preferably between 5% and 50%, more preferably 10–40% by weight.

Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophilic group, i.e.; water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the C10 to C18 primary normal alkyl sodium and potassium sulfonates, with the C10 to C15 primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 5 to 50% and more preferably 10 to 20% by weight.

The alkali metal sulfonate can be used in admixture with the alkylbenzene sulfonate in an amount of 0 to 70%, preferably 10 to 50% by weight.

Also normal alkyl and branched chain alkyl sulfates (e.g., primary alkyl sulfates or secondary alcohol sulfates) may be used as the anionic component.

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2CH_2O)_p—SO_3M,$$

where R' is $C_8$ to $C_{20}$ alkyl, preferably $C_{10}$ to $C_{18}$ and more preferably $C_{12}$ to $C_{15}$; P is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70%, preferably 5 to 50% and more preferably 10 to 20% by weight of entire composition.

Anionic surfactants particularly useful for this application include, but are not limited to: linear alkyl benzene sulfonates (e.g. Vista C-500 from Vista Chemical Co.), alkyl sulfates (e.g. Polystep B-5 from Stepan Co.), polyoxyethylenated alkyl sulfates (e.g. Standapol ES-3 from Stepan Co.), alpha olefin sulfonates (e.g. Witconate AOS from Witco Corp.), alpha sulfo methyl esters (e.g. Alpha-Step MC-48 from Stepan Co.) and isethionates (e.g. Jordapon CI from PPG Industries Inc.).

Anionic surfactant is used in the formulation from about 0% to about 60%, preferably between 5% and 40%, more preferably 8 to 25% by weight.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention a re de scribed in detail in U.S. Pat. No. 4,497,718, hereby incorporated by reference.

As with the nonionic and anionic surfactants, t he compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxy, sulfonate, sulfate.

Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyidodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of amphoteric used may vary from 0 to 50% by weight, preferably 1 to 30% by weight.

It should be noted that the compositions of the invention are preferably isotropic (by which is generally understood to be a homogenous phase when viewed macroscopically) and either transparent or translucent.

Total surfactant used must be at least 15%, preferably at least 20%, more preferably 21% by wt., even more preferably 25% by wt.

Builders/Electrolyte

Builders which can be used according to this invention include conventional alkaline detergency builders, inorganic or organic, which can be used at levels from about 0% to about 50% by weight of the composition, preferably from 1% to about 35% by weight.

As used herein, the term electrolyte means any water-soluble salt.

Preferably the composition comprises at least 1.0% by weight, more preferably at least 5.0% by weight, most preferably at least 10.0% by weight of electrolyte. The electrolyte may also be a detergency builder, such as the inorganic builder sodium tripolyphosphate, or it may be a non-functional electrolyte such as sodium sulfate or chloride. Preferably the inorganic builder comprises all or part of the electrolyte.

Although no electrolyte is required, preferably at least 1% electrolyte is used, more preferably 3% to as much as about 50% by weight electrolyte.

The compositions of the invention are capable of suspending particulate solids, although particularly preferred are those systems where such solids are actually in suspension. The solids may be undissolved electrolyte, the same as or different from the electrolyte in solution, the latter being saturated electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used are water-soluble alkali metal phosphates, polyphosphates, borates, silicates and also carbonates. Specific examples of such salts are sodium and potassium triphosphates, pyrophosphates, orthophosphates, hexametaphosphates, tetraborates, silicates, and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetra-phosphonic acid; (4) water-soluble salts of polycarboxylates polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TPS).

Certain zeolites or aluminosilicates can be used. One such aluminosilicate which is useful in the compositions of the invention is an amorphous water-insoluble hydrated compound of the formula $Na_x[(AlO_2)_y.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 mm to about 5 mm. This ion exchange builder is more fully described in British Pat. No. 1,470,250.

A second water-insoluble synthetic aluminosilicate ion exchange material useful herein is crystalline in nature and has the formula $Na_z[(AlO_2)_y(SiO_2)]_xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 mm to about 100 mm; a calcium ion exchange capacity on an anhydrous basis of at test about 200 milligrams equivalent of $CaCO_3$ hardness per gram; and a calcium exchange rate on an anhydrous basis of at least about 2 grains/gallon/minute/gram. These synthetic aluminosilicates are more fully described in British Pat. No. 1,429,143.

Enzymes

Enzymes which can be used in this invention are described in greater detail below.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism Chromobacter viscosum var. lipolyticum NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immune diffusion procedure according to Ouchterlony (Acta. Med. Scan., 133. pages 76–79 (1930).

The preparation of the antiserum is carried out as follows:

Equal volumes of 0.1 mg/ml antigen and of Freund's adjuvant (complete or incomplete) are mixed until an emulsion is obtained. Two female rabbits are injected 45 with 2 ml samples of the emulsion according to the following scheme:

day 0: antigen in complete Freund's adjuvant day 4: antigen in complete Freund's adjuvant day 32: antigen in incomplete Freund's adjuvant day 64: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchteriony procedure. A dilution of antiserum was the dilution that still gave a visible precipitation with an antigen concentration of 0.1 mg/ml.

All bacterial lipases showing a positive immunological cross reaction with the TJ-lipase antibody as hereabove described are lipases suitable in this embodiment of the invention. Typical examples thereof are the lipase ex Pseudomonas fluorescens IAM 1057 (available from Amano Pharmaceutical Co., Nagoya, Japan, under the trade-name Amano-P lipase), the lipase ex Pseudomonas fragi FERM P 1339 (available under the trade-name Amano B), the lipase ex Pseudomonas nitroreducens var. lipolyticum FERM P1338, the lipase ex Pseudomonas sp. (available under the trade-name Amano CES), the lipase ex Pseudomonas cepacia, lipases ex Chromobacter viscosum, e.g. Chromobacter viscosum var. lipolyticum NRRL B-3673, commercially available from Toyo Jozo Co., Tagata, Japan; and further Chromobacter viscosum lipases from U.S. Biochemical Corp. USA and Diosynth Co., The Netherlands, and lipases ex Pseudomonas gladioli.

An example of a fungal lipase as defined above is the lipase ex Humicola lanuginosa available from Amano under the tradename Amano CE; the lipase ex Humicola lanuginosa as described in the aforesaid European Pat. Application 0,258,068 (NOVO), as well as the lipase obtained by cloning the gene from Humicola lanuginosa and expressing this gene in Aspergillus oryzae, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/mI in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/mmol of titratable fatty acid per minute in a pH state under the following conditions: temperature 30° C.; pH=9.0; substrate is an emulsion of 3.3 wt. % of olive oil and 3,3% gum arabic, in the presence of 13 mmol/l $Ca^{2+}$ and 20 mmol/l NaCl in 5 mmol/l Trisbuffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of B. subtilis and B licheniformis. Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with cofactors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym from Novo.

Optional Ingredients

In addition to the enzymes mentioned above, a number of other optional ingredients may be used.

Alkalinity buffers which may be added to the compositions of the invention include monoethanolamine, triethanolamine, borax, sodium silicate and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 30% montmorillonite and thus its cation exchange capacity is at least about 50 to 75 meg per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guam.

In addition, various other detergent additives of adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose, A preferred anti-redeposition agent is sodium carboxylmethyl cellulose having a 2:1 ratio of CM/MC which is sold under the tradename Relatin DM 4050.

Another minor ingredient is soil releasing agents, e.g. deflocculating polymers. In general, a deflocculating polymer comprises a hydrophilic backbone and one or more hydrophobic side chains.

The deflocculating polymer of the invention is described in greater detail in U.S. Pat. No. 5,147,576 to Montague et al. hereby incorporated by reference into the subject application, The deflocculating polymer generally will comprise, when used, from about 0.1 to about 5% of the composition, preferably 0.1 to about 2% and most preferably, about 0.5 to about 1.5%.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Optionally, the inventive compositions may contain all or some the following ingredients: zwitterionic surfactants (e.g. Mirataine BET C-30 from Rhone-Poulenc Co.), cationic surfactants (e.g. Schercamox DML from Scher Chemicals, Inc.), fluorescent dye, antiredeposition polymers, antidye transfer polymers, soil release polymers, protease enzymes, lipase enzymes, amylase enzymes, cellulase enzymes, peroxidase enzymes, enzyme stabilizers, perfume, opacifiers, UV absorbers, builders, and suspended particles of size range 300–5000 microns.

Structure Formation

In most polymer-structured systems, polymers form a continuous network through the system. Polymers in these types of systems are prone to dehydration or a salting out effect. These polymers include families of Xanthan gum, polyacrylates, etc. Surprisingly, applicants have discovered that one can construct a system with either continuous network suspending system (e.g., using xanthan gum) or non-continuous gum particle suspending networks (e.g., using carrageenan or gellan) to form a highly shear-thinning Theological property while maintaining a high degree of transparency. The size of the transparent particles (in the non-continuous system) can be in the range of less than 5000, preferably less than 3000, more preferably less than 2000 microns to sub-micron. The reflect index of the gum network is similar to the bulk liquid detergent such that the liquid is translucent or transparent.

While not wishing to be bound by theory it is believed that, in the non-continuous system, the discrete gum particles form a non-continuous network structure by contacting the surrounding particles. The Coulumbic friction force at the contacting points forms a structure that can suspend other visible particles (e.g., enzyme or bleach containing capsule). Furthermore, the structure formed by the Coulumbic friction force can be easily destroyed by a shear force, such as pouring the liquid detergent, and exhibits a low viscosity behavior. In general, the distribution of particles or bits in liquid is dependent on the net buoyant force (the sum of gravitational and buoyant forces) and coulombic force. The net buoyant force supports parts of the weight of bits. The rest part of the weight of bits is supported by the underlying layer of solid particles or the bottom and wall of vessel. This support force is referred to as the Coulombic force. The friction force between particles is proportional to this Coulombic force. This friction force also provides the structuring of system.

The gum particles are prepared either by pre-forming gum particles and adding to the final product or by forming gum particles in-situ with the rest of the liquid detergent compositions.

As for continuous network (formed, e.g., with xanthan), these are formed by a slightly different process (wherein gum premix is formed and certain ingredients are added before others) described in applicants copending application, hereby incorporated by reference into the subject application.

Flow Properties

The pour viscosity of the present aqueous liquid detergent composition can be in the range of 50 to 3000 centipoises, preferably 100 to 2000 centipoises, more preferably 150 to 1500. The pouring viscosity is measured at a shear rate of 21 1/sec measured at temperature of about 25° C. In the subject invention, viscosity was measured using a Haake RV20 Rotovisco meter, RC20 Rheocontroller, and Haake F3-C circulators. Either MV1, MV2 or MV3 sensor system (e.g., cylindrical spindle) was used for the measurement. At the viscosities mentioned, the liquid detergent is easily pourable. The present aqueous liquid detergent composition is stable and can suspend 300 to 5000 micron particles.

Physical Properties

The compositions pertaining to this invention exhibits several special characteristics in Rheological properties, transmittance and storage stability.

Consumers tend to prefer a thick liquid detergent products, but to also require that products pour easily. These two contradictory requirements only can be achieved by creating a formulation that has a highly shear thinning behavior. This means that, at pouring stage (scientifically defined at about the shear rate of 21 1/sec), the pouring viscosity value of the present liquid detergent compositions should be less than 3,000 centipoises, more preferably less than 1,500 centipoises and most preferably less than 1,000 centipoises. At the viscosities mentioned, the liquid detergent is easily pourable.

The present aqueous liquid detergent composition can suspend 300 to 5,000 micron particles for at least 2 weeks preferably at least 3 weeks, most preferably at least 5 weeks at room temperature.

The compositions of the invention have at least 50% transmittance of light using a 1 centimeter cuvette, at a wavelength of 410–800 microns, preferably 570 to 690 microns, wherein the composition is measured in absence of dyes.

Alternatively, transparency of the composition may be measured as having an absorbency in the visible light wavelength (about 410 to 800 nm) of less than 0.3 which is in turn equivalent to at least 50% transmittance using cuvefte and wavelength noted above. For purposes of the invention, as long as one wavelength in the visible light range has greater than 50% transmittance, it is considered to be transparent/translucent.

One of the properties of the compositions of the invention is that it contains gums which have been pre-swollen (with water) because, it is believed, in this way the gum is able to absorb water when not in the presence of surfactant and/or electrolyte and thus does not have to compete with the surfactant and/or electrolyte for available water.

There are a variety of ways that can be used for testing how swollen a gum (or other material) has gotten. These include the use of dyes or other indicators (e.g., toluidine blue 0; methylene blue one iodine). By applying the indicator, the degree of swelling (due to water) of a given gum polymer may be readily observed.

Suspended Particles

Technically, it is well known in the art that heavy duty liquid detergents provide a hostile environment for desirable ingredients such as, for example, bleaches, enzymes and perfumes. Components which are sensitive to the ingredients found in the compositions (e.g., enzymes in detergent compositions, particularly concentrated detergent compositions, are denatured by surfactants in the detergent composition) can be encapsulated and protected until they are ready for release. Some types of encapsulated enzyme capsules are disclosed in U.S. Pat. No. 5,281,355 to Tsaur et al. and U.S. Pat. No. 5,589,370 to Ratuiste et al. Commercial enzyme granules originally designed for powder detergent, such as Purafect 3100G, can also be used in this application.

Components which are simply more desirably released later in the wash (e.g., perfumes, fabric softening agents or anti-foams) can be encapsulated and controllably released, for example, by dilution of a concentrated liquid.

Other components, such as anti-redeposition agent CP-5 polymer or builder zeolite are not dissoluble in isotropic heavy duty liquid detergent compositions. These fine, insoluble particles cause the opaqueness of products. To prevent the opaqueness, these fine particle components can be pre-granulated and post dosed as suspended particles.

Liquid components that are immiscible with liquid detergent compositions, such as amino silicone and silicone defoamer can be incorporated as encapsulates. Functional polymers including color protecting polymers, fabric protection polymers and soil release polymers, such as PVP (polyvinylpyrrolidone), Narlex DC-1 ex National Starch (e.g., polyacrylate copolymer) and that can be salted out due to the high electrolyte concentration in liquid detergent compositions also can be incorporated in an encapsulated form.

In particular, it is desirable to encapsulate one or more enzymes since enzymes are highly efficient laundry washing ingredients used to promote removal of soils and stains during the cleaning process. Furthermore, it is also desirable to encapsulate bleach and enzymes separately to further enhance detergent efficacies.

Aesthetically, inclusion of suspended particles in the liquid produces a product form not previously seen in the HDL category by consumers which may be appealing. Thus, particles that do not contain any detergent ingredients may be also used in this application.

The size of the suspended particles used in this application is in the range of 300 to 5000 microns, preferably 500 to 2500 microns, and most preferably 700 to 2000. The density should be in the range of 0.8 to 3 g/cm$^3$, preferably in the range of 0.9 to 1.8 g/cm$^3$, and most preferably in the range of 0.95 to 1.20 g/cm$^3$.

Preparation of Composition

There are several preferred processing routes to prepare transparent structured heavy duty liquid detergents. The first processing route comprises (1) preparing 0.05% to 10% polymer gum solution by blending polymer or polymers comprising gum into water and providing enough heat or time for polymer(s) molecules to be swollen; (2) forming suspending particles (e.g., molecules of gum which will form non-continuous network and suspend) by agitating, using counterion effect (w/electrolyte, e.g., sodium citrate) and/or using temperature effects; and (3) adding the suspending particles to liquid detergent formula.

The second processing route comprises (1) preparing 0.05% to 10% gum solution by blending polymer or polymer comprising gum into water and providing enough heat or time for gum molecules to be swollen; (2) forming suspending particles in situ by contacting the gum solution and liquid detergent formula.

The first two processes are generally applicable for non-continuous process.

A particular structured liquid composition of the invention made using a non-continuous process may be one structured using gellan gum. Such composition may be prepared using the following steps: 1) preparing an aqueous gellan gum solution; and 2) mixing the remaining ingredients of the liquid detergent composition into the gellan gum solution. The remaining ingredients may comprise ingredients selected from the group consisting of surfactants and builders and mixtures thereof. For the first step, preferably 0.01–10 wt. %, more preferably 0.03–7 wt. %, even more preferably 0.05–5 wt. % gellan gum is dissolved in an aqueous base to form an aqueous solution wherein aqueous base is preferably water. Heating said solution is often needed to dissolve the gellan gum adequately. The temperature of said solution is preferably raised in excess of $_{80}$° C., more preferably in excess of 85° C., most preferably in excess of 90° C. However, it is necessary to cool down said solution before addition of temperature sensitive ingredients—such as enzymes—to the gellan gum solution. This may cause a technical problem since cooling down the gellan gum solution may increase the viscosity or—depending on the gellan gum concentration—even cause setting of the gel, making it difficult to mix in the remaining ingredients.

To prevent the increase in viscosity or setting, it is preferred to add an alkaline material to the gellan gum solution before cooking the solution and when the solution is still fluid.

The alkaline material may be any alkaline material suitable for use in laundry applications. Preferably the alkaline material is selected from the group including alkali metal hydroxides, carbonates, bicarbonates, silicates, alkanolamines, and mixtures thereof. Preferred bases are selected form the group including sodium hydroxide, potassium hydroxide, sodium carbonate, potassium carbonate, sodium and potassium bicarbonates monoethanolamine, diethanolamine, triethanolamine, silicates, metasilicates, disilicates and mixtures thereof.

Preferably, sufficient amount of the alkaline material is added to increase the pH to at least 9, more preferably 9.5, even more preferably 10, most preferably 10.5. After addition of the base, the gellan gum solution is preferably cooled to a temperature of lower than 80° C., more preferably lower than 75° C., most preferably lower than 70° C.

Other ingredients of the liquid detergent composition may also promote setting, for example, compounds comprising 3 valent ions. Preferred compounds comprising 3 valent ions include compounds containing boron or phosphate. It is therefore preferred to add ingredients that promote setting of the liquid after the other ingredients, such as surfactants and/or builders, have been mixed into the gellan gum solution. If C1–C6 alcohols and compounds with 3 valent ions are used, it is preferred that said compound is added after said alcohol. Said compound is preferably selected from compounds containing boron including borax, boric acid, borate and compounds containing phosphate, such as sodium tripolyphosphate. Said alcohol is preferably selected from the group including propylene glycol, glycerol, ethanol, propanol and butanol.

A third type of process for making compositions of the invention comprises: (1) preparing 0.05% to 10% polymer gum solution by blending polymer or polymer comprising gum into water and providing enough heat or time for polymers to be swollen; (2) adding nonionic components (particularly surfactant) and remaining water; and (3) subsequently adding any ionic components (including cationic or anionic surfactants or electrolytes).

This third process is generally applicable to continuous type processes.

In one embodiment, the liquids of the invention are used in combination with a transparent/translucent clear bottle.

Clear bottle materials with which this invention may be used include, but are not limited to: polypropylene (PP), polyethylene (PE), polycarbonate (PC), polyamides (PA), polyethylene terephthalate (PETE), polyvinylchloride (PVC) and/or polystyrene (PS).

The transparent container according to the invention preferably has a transmittance of more than 25%, more preferably more than 30%, more preferably more than 40%, more preferably more than 50% in the visible part of the spectrum (approx. 410–800 nm).

Alternatively, absorbency of bottle may be measured as less than 0.6 (approximately equivalent to 25% transmittance or by having transmittance greater than 25% wherein % transmittance equals:

$$\frac{1}{10^{absorbancy}} \times 100\%$$

For purposes of the invention, as long as one wavelength in the visible light range has greater than 25% transmittance, it is considered to be transparent/translucent.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following examples are intended to further describe the invention and are not intended to limit the invention in any way. Unless noted otherwise, all percentages are intended to be by weight.

EXAMPLES 1–4

Preparation of Suspended Capsules

Several types of capsules were prepared in the lab to use for suspending and storage studies. The composition variations are shown in Table 1.

TABLE 1

| Raws | Example 1, g | Example 2, g | Example 3, g | Example 4, g |
|---|---|---|---|---|
| deionized water | 2820.00 | 98.00 | 32.20 | 29.40 |
| K-carrageenan gum | 60.00 | 2.00 | 0.80 | 0.60 |
| Zeolite | 90.00 | 0.00 | 4.00 | 2.00 |
| white pigment | 30.00 | 0.00 | 0.00 | 0.00 |
| 30% PVP solution | 0.00 | 40.00 | 40.00 | 20.00 |
| Fluorescent dye | 0.00 | 1.00 | 0.00 | 0.00 |

PVP = polyvinylpyrrolidone

Specifically, Kappa-carrageenan gum powder and water were mixed and heated to 160° F. until the gum was well dispersed and hydrated. Other ingredients were added according to the list of Table 1 and mixing was continued until the ingredients were well mixed. The composition was cooled to room temperature for spraying through a two-fluid nozzle into a 5% KCl hardening solution bath. Capsules were collected and passed through screens of 500 and 2000 microns.

Example 5

Preparation of Suspended Capsules

Capsules using gellan gum were also prepared by: a) mixing 1000 g of deionized water, 5 g of Kelcogel LT (gellan gum Ex Monsanto) and 1.5 g of sodium citrate; b) mixing and heating to 180° F. for 30 minutes; c) turning off heat and mixing in 10 g pigment; d) letting cool to room temperature; and e) spraying through two-fluid nozzle into 10% NaCl hardening solution.

Example 5 typifies the compositions of these type of capsule particles.

| Particles | | | | |
|---|---|---|---|---|
| Raws | Kelcogel LT | Water | sodium citrate | Pigment |
| G | 5 | 1000 | 1.5 | 10 |
| Hardening solution | | | | |
| Raws | NaCl | Water | | |
| G | 200 | 1800 | | |

Other functional ingredients were added to the gellan capsules similar to ingredients added to kappa-carrageenan capsules of Examples 1–4. Other examples of ingredients which can be added to the capsules include PVP (polyvinylpyrrolidone), fluorescent dye and silicone oil.

Examples 6 to 11

Transparent, Pourable Liquids with Suspending Capability

Six liquid detergent were prepared and have compositions as shown in Table 2 below:

TABLE 2

| | Example 6 by wt. % | Example 7 by wt. % | Example 8 by wt. % | Example 9 by wt. % | Example 10 by wt. % | Example 11 by wt. % |
|---|---|---|---|---|---|---|
| gellan/sodium citrate solution (for polymer gum network formation)[A] | 6.8 | 6.8 | 6.8 | 6.8 | 6.8 | 22.7 |
| Alcohol ethoxylate | 20.0 | 17.5 | 15.0 | 12.5 | 20.0 | 20.0 |
| Alcohol ethoxylsulfate | 7.5 | 10.0 | 12.5 | 15.0 | 0. | 0. |
| Na-LAS (sodium linear alkyl benzene sulfonate) | 0. | 0. | 0. | 0. | 7.75 | 0. |
| Triethanol amine | 4.0 | 4.0 | 4.0 | 4.0 | 4.0 | 4.08 |
| PVP (Polyvinylpyrollidone) | 0.6 | 0.6 | 0.6 | 0.6 | 0.6 | 0.6 |
| Alcosperse 725 ex National Starch (soil release polymer) | 0.35 | 0.35 | 0.35 | 0.35 | 0.35 | 0.35 |
| Fluorescer dye | 0.2 | 0.2 | 0.2 | 0.2 | 0.2 | 0.2 |
| Preservative | 0.0003 | 0.0003 | 0.0003 | 0.0003 | 0.0003 | 0.0003 |
| Water | to 100 | to 100 | to 100 | to 100 | to 100 | to 100 |
| Capsules from Example 1; $d_{50}$ = 1000 microns | 1* | 1 | 1 | 1 | 1 | 1 |
| storage stability, week | >2 | >2 | >2 | >2 | >2 | >2 |

*1 w/w % suspending particles are based on HDL weight.
[A]6.75 gellan solution with 0.25% sodium citrate and balance water The general procedure for preparing the liquid detergent compositions 6 to 11 of Table 2 was as follows: 1000 g gellan and sodium citrate premix solution was prepared by blending 7.5 g of the gellan gum (e.g., Kelcogel) with 2.5 g of sodium citrate and deionized water. Once the mixture was well blended, it was brought up to 180° F. and mixed at that temperature for 1 hour. The premix was then allowed to cool to room temperature. Batches were made on the benchtop using Tekmar stirrers. At this stage, the gellan gum premix was a mixture of concentrated gellan gum particle. Raw materials for making liquid detergent base were added separately following the order of water, triethanol amine, PVP, Alcosperse 725, Fluorescer dye, and LAS acid. This was followed by adjusting pH to 9.0 with 50 w/w % NaOH solution followed by the addition of alcohol ethoxysulfate, alcohol ethoxylate and preservative. The gellan gum premix was then added and mixed in with the liquid detergent base (i.e., to form suspending network). One weight percent of capsules prepared by Example 1 (based on the HDL weight) was then added and dispersed. Storage study were carried out at room temperature to determine the capsule suspending capacity of the HDL (heavy duty liquid) base. As shown in Table 2, Examples 6 to 11 are all capable of suspending 1000 micron particles (capsules) for more than 2 weeks.

These examples clearly show transparent/translucent liquid which are stable, can suspend large particles (i.e., capsule) and are pourable. Viscosity of the six compositions was between 1000 to 1100 cp at $21S^{-1}$ apparent shear rate.

Example 12–14

Non-continuous Method

The following examples were made following a different process route from Examples 6 to 11 to prepare the compositions shown in Table 3.

TABLE 3

| Base | Example 12, lb. | Example 13, lb. | Example 14, lb. |
|---|---|---|---|
| Deionized water | 6.18 | 6.18 | 6.18 |
| Sodium citrate | 2.50 | 2.50 | 2.50 |

TABLE 3-continued

| Base | Example 12, lb. | Example 13, lb. | Example 14, lb. |
|---|---|---|---|
| 50% NaOH solution | 2.10 | 2.10 | 2.10 |
| Propylene glycol | 3.38 | 3.38 | 3.38 |
| Premix I | | | |
| Deionized water | 8.00 | 8.00 | 8.00 |

TABLE 3-continued

| Base | Example 12, lb. | Example 13, lb. | Example 14, lb. |
|---|---|---|---|
| Sorbital solution | 6.44 | 6.44 | 6.44 |
| Borax | 3.06 | 3.06 | 3.06 |
| LAS acid | 10.30 | 10.30 | 10.30 |
| Neodol 25-9* | 12.00 | 12.00 | 12.00 |
| Sodium ethoxyl sulfate | 39.26 | 39.26 | 39.26 |
| Premix II | | | |
| Fluoreser | 0.15 | 0.15 | 0.15 |
| Water | 4.00 | 4.00 | 4.00 |
| 50% NaOH | 0.05 | 0.05 | 0.05 |
| Preservative | 0.02 | 0.02 | 0.02 |
| Protease | 0.46 | 0.46 | 0.46 |
| Lipolase | 0.83 | 0.83 | 0.83 |
| Perfume | 0.30 | 0.30 | 0.30 |
| Deionized water | 0.97 | 0.97 | 0.97 |
| Gum solution (Network formation) | | | |
| Gellan gum | 0.25 | 0.15 | 0.15 |
| Deionized water | 49.75 | 49.75 | 49.85 |
| Preservatives | 0.01 | 0.01 | 0.00 |
| Capsules from Example 5; (to be suspended) | 1%; $d_{50}$ = 1000 microns | 2%; $d_{50}$ = 2000 microns | 2.5%; $d_{50}$ = 2500 microns |
| Storage stability, week | >2 | >2 | >2 |

*$C_{12}$–$C_{15}$ alkyl chain ethoxylate with 9 EO groups

The general procedure for preparing the liquid detergent compositions 12 to 14 of Table 3 was as follows: A gellan gum solution was prepared by blending the Kelcogel gum (gellan gum) with deionized water. Once the mixture was well blended, it was brought up to 180° F. and mixed at that temperature for 1 hour to ensure hygiene protection. The gellan solution was then allowed to cool to room temperature. Preservative was added after the gellan solution was cooled to room temperature. Batches were made in the pilot plant using Lightening mixers. At this stage, the gellan gum mixture was a transparent isotropic liquid. The raw materials for making liquid detergent base were added following the order of raw materials listed in Table 3.

There were two ways to incorporate the gellan gum solution into the liquid detergent base. First was to gradually add gellan gum solution into the liquid detergent base while the system was still agitating. The gellan gum particles were formed with the interaction of gellan gum molecules and surfactant/citrate. Another method was gradually adding the liquid detergent base to the mixing gellan gum solution. The gel was formed by the interaction of gellan gum molecule and surfactant/citrate. The continuous mixing was for maintaining the size of gellan gum particles to be small and exhibit smoother appearance. After the network was formed, the rate of addition of liquid detergent base was sped up. Various sizes and amounts of capsules prepared by Example 5 (based on the HDL weight) were added to Examples 12 to 14 and dispersed. As shown in the Table 3, Examples 12 to 14 are all capable of suspending particles having an average size of 1000 to 2500 microns for more than 2 weeks under room temperature condition.

The viscosity of these compositions was between 700 and 750 cp at 21 $S^{-1}$ apparent shear rate.

Examples 15 to 16

The compositions of Examples 15 and 16 in Table 4 were prepared and followed the procedure described in Examples 12 to 14.

TABLE 4

| Heavy Duty Liquid | Example 15, g | Example 16, g |
|---|---|---|
| sodium citrate | 31.61 | 0.00 |
| deionized water | 299.26 | 251.84 |
| 50% NaOH | 50.58 | 50.58 |
| LAS acid | 222.34 | 222.34 |
| Neodol 25-9 | 98.00 | 98.00 |
| Premix I | | |
| deionized water | 21.07 | 21.07 |
| Fluorescer dye | 2.11 | 2.11 |
| 50% NaOH | 1.05 | 1.05 |
| Monoethanol amine gum solution | 15.81 | 15.81 |
| Gellan gum | 1.01 | 1.01 |
| Deionized water | 336.19 | 336.19 |
| Premix II | | |
| Deionized water | 0.00 | 47.42 |
| Sodium citrate | 0.00 | 31.61 |
| Capsules from Example 5; $d_{50}$ = 1500 mm | 1.5% | 1.5% |
| storage stability, week | >2 | >2 |

The structure of composition was formed like example 12. The manner of addition of Example 16 (i.e., citrate is added after structure is formed) implies that the structure was formed with surfactant. Capsules with average size of 1500 microns which were prepared according to Example 5 were used for storage study. About 1.5% of capsules were added and dispersed in the samples of Examples 15 and 16. The room temperature storage results show that the capsules are still suspended after two weeks storage. This again shows formation of transparent/translucent liquids able to form stable, suspending compositions which are pourable.

Viscosity of these compositions was about 710 cp at 21$S^{-1}$ apparent shear rate.

Example 17 to 18

Examples 17 to 18 in Table 5 demonstrate the unexpected results of structuring high pH liquid detergent compositions with gellan gum and maintaining the transparency and pourability. The order of addition is following the list of ingredients in the Table 5.

TABLE 5

| Ingredients | Example 17, g | Ingredients | Example 18, g |
|---|---|---|---|
| Deionized water | 209.94 | Sodium citrate | 12.50 |
| 50% NaOH | 45.26 | Water | 72.86 |
| LAS acid | 152.49 | 50% NaOH solution | 11.21 |
| Alcohol ethoxylate | 46.02 | 40% Na xylene sulfonate | 10.00 |
| Premix I | | LAS acid | 44.50 |
| Deionized water | 9.82 | Neodol 25-9 | 18.45 |
| Fluorescent dye | 1.34 | Premix-I | |
| Stearic acid | 0.69 | Water | 5.00 |
| 40% sodium xylene sulfonate | 32.22 | Fluorescent dye | 0.50 |
| Alcohol ethoxylate | | 50% NaOH solution | 0.25 |
| | | Gum solution | |
| Premix II; | | Gellan gum | 0.38 |

TABLE 5-continued

| Ingredients | Example 17, g | Ingredients | Example 18, g |
|---|---|---|---|
| check pH ~12 | | Water | 74.61 |
| Sodium silicate | 44.46 | Premix-II, check pH ~12 | |
| Water | 1.84 | Sodium silicate | 3.60 |
| Gum solution | | Water | 0.15 |
| Gellan gum | 1.25 | Monoethanolamine | 3.75 |
| Deionized water | 248.75 | Capsules from | 1.0% |
| Capsules from | 1.5% | Example 5; | |
| Example 5; | | $d_{50}$ = 3500 microns | |
| $d_{50}$ = 1500 microns | | Storage stability, week | >2 |
| Storage stability, week | >2 | | |

About 1.5% of capsules from Example 5 with average size of 1500 microns were added and dispersed in the samples of Example 17. One percent of average 3500 mm particles prepared by Example 5 was added and dispersed in the sample of Example 18. The room temperature storage results show that the particles are still suspended after two weeks storage.

Examples 19 to 21

Examples 29 to 21 used kappa-carrageenan gum as a structurant. Example 19 used in-situ method to prepare gum particles and Examples 20 and 21 used sodium citrate to pre-form gum particle mixture. The order of preparation was following the list in Table 6.

TABLE 6

| Ingredients | Example 19, g | Example 20, g | Example 21, g |
|---|---|---|---|
| Deionized water | 16.00 | 16.00 | 16.00 |
| 40% Na-xylene sulfate | 12.80 | 0.00 | 0.00 |
| Propylene glycol | 4.32 | 4.32 | 4.32 |
| 50% NaOH solution | 0.00 | 0.00 | 2.20 |
| Monoethanol amine | 6.00 | 0.46 | 0.00 |
| Coconut fatty acid | 1.60 | 1.60 | 1.60 |
| Triethanol amine | 40.00 | 4.18 | 0.00 |
| LAS acid | 39.30 | 9.28 | 9.28 |
| Alcohol Ethoxylate | 15.00 | 8.70 | 8.70 |
| Sodium borate, pentahydrated | 5.86 | 5.86 | 5.86 |
| Sodium citrate, dihydrated | 3.00 | 3.00 | 3.00 |
| Alcohol ethoxysulfate | 0.00 | 55.06 | 55.06 |
| Preservative | 0.00 | 0.04 | 0.04 |
| Gum solution | | | |
| Kappa-carrageenan | 0.08 | 0.08 | 0.08 |
| Sodium citrate, dihydrated | 0.00 | 3.00 | 3.00 |
| Water | 39.92 | 39.92 | 39.92 |
| Water | 46.12 | 48.50 | 50.94 |
| Capsules from Example 1; $d_{50}$ = 1000 microns | 1% | 1% | 1% |
| Storage stability, week | >2 | >2 | >2 |

One weight percent of capsules prepared by Example 1 (based on the HDL weight) were added and dispersed. Storage study were carried out at room temperature to determine the suspending capacity of HDL base. As shown in the Table 6, Examples 19 to 21 were all capable of suspending 1000 micron particles for more than 2 weeks.

Comparative 600 micron sized capsules from Example 1 based on carrageenan and zeolite were added to Wisk® laundry detergents; within 20 minutes at room temperature, all the particles sank to the bottom of the container.

This example clearly shows that, if not prepared in a particular way, the transparent, suspending compositions of the invention are not formed.

Example 22

Continuous

This example demonstrates a formulation based on nonionic surfactant:

Deionized water, PVP, soil release polymer and f-dye fluorescers were added together and the mixture was heated to 180° F. As a premix, xanthan gum and triethanolamine were combined and agitated until the gum was well dispersed throughout the TEA. This premix was then added to the main mix and the entire batch was held at 180° F. for 30 minutes to ensure hygienic processing. Finally, after heating was complete, nonionic was added to the main mix and the system was blended until homogeneous.

Composition ingredients are set forth in Table 7 below:

TABLE 7

| Ingredient | Raw (as 100% active) |
|---|---|
| Water | 64.30 |
| Nonionic | 27.50 |
| TEA | 4.00 |
| PVP | 0.25 |
| Soil release polymer | 0.35 |
| f-dye | 0.20 |
| Xanthan gum | 0.40 |

This example showed that, using continuous gum network, transparent, pourable compositions were formed which were able to suspend capsules of Example 1 (1000 micron size) for greater than 6 months at room temperature.

Example 23–24

TABLE 8

| Ingredients | Example 23 g. | Example 24 g. |
|---|---|---|
| Deionized water | 301.68 | 301.68 |
| 50% NaOH solution | 67.08 | 67.08 |
| 40% sodium xylene sulfonate | 42.59 | 42.59 |
| LAS acid | 242.41 | 242.41 |
| Neodol 25-9 | 107.62 | 107.62 |
| Coconut fatty acid | 14.20 | 14.20 |
| Premix | | |
| Fluorescent dye | 2.84 | 2.84 |
| Water | 17.75 | 17.75 |
| 50% NaOH - adjust pH to ~12 with 50% NaOH | 0.21 | 0.21 |
| 47.1% sodium silicate | 81.63 | 81.63 |
| 40% Alcosperse 725 | 8.52 | 8.52 |
| Gum solution | | |
| Gellan | 0.45 | 0.31 |
| Hydroxypropyl methylcellulose | 0.00 | 0.45 |
| Deionized water | 90.05 | 89.74 |
| Misc. | To 1000 | To 1000 |

Example 23 in Table 8 above demonstrates that low level of structuring agent, e.g., 0.045% is sufficient to structure liquid detergent with high pH and high active level. Example 24 demonstrates that the enhancement of suspending power of mixing two different structuring agents, gellan gum Methocel J12mS (hydroxypropyl Methylcellulose) ex. Dow.

Example 25

Example 25 shows the absorbance of Henkel Persil Color Gel—a thick HDL from Henkel—versus a formula of the current invention (Note: Henkel Gel is blue in color so the red end of the visible spectrum was used as to not have absorbance from the blue dye):

TABLE 9

Transmittance calculation for Owen samples

| | Henkel Persil Color Gel | | 6 | | 18 | |
|---|---|---|---|---|---|---|
| Wavelength Example | Absorbance | Transmittance, % | 6 Absorbance | Transmittance, % | 18 Absorbance | Transmittance, % |
| 570 | 1.36 | 4.37 | 0.011 | 97.50 | 0.082 | 82.79 |
| 590 | 1.54 | 2.88 | 0.01 | 97.72 | 0.068 | 85.51 |
| 610 | 1.74 | 1.82 | 0.009 | 97.95 | 0.061 | 86.90 |
| 630 | 2.1 | 0.79 | 0.009 | 97.95 | 0.057 | 87.70 |
| 670 | 1.36 | 4.37 | 0.008 | 98.17 | 0.052 | 88.72 |
| 690 | 1.15 | 7.08 | 0.007 | 98.40 | 0.047 | 89.74 |

As can be seen from the results, Henkel Persil Color Gel has higher absorbance values than the inventive formulation. This indicates that the structuring mechanism is quite different than in our case. Further, 600 micron sized particles based on carrageenan and zeolite were added a Henkel WIIPP gel detergent (different than the Henkel Persil above) and within 20 minutes, all the particles sank to the bottom of the container.

Example 26

A gellan gum-structured liquid detergent composition was prepared by the following process (the steps were carried out in the order stated in the table below):

| | |
|---|---|
| Demineralized water | 50.98% |
| Gellan gum | .22 |
| Heated up to 90° C. | |
| NaOH (50%) | 1.5 |
| Cooling 50° C. | |
| Propylene glycol | 3.5 |
| Na citrate 2 aq | 5.5 |
| LAS (BDH) | 7.5 |
| Nonionic (Neodol 25-9) | 7.7 |
| LES (BSS-P 58%) | 23.1 |

LAS is linear alkyl sulfonate

After cooling the gellan gum solution remained fluid and the remaining ingredients could be easily mixed. When the same composition was prepared whereby the alkaline material was added after the cooling step, the gellan gum solution started to thicken at 70° C., making the mixing of the remaining ingredients problematic.

Example 27

The following gellan gum-structured liquid detergent composition with a compound containing boron was prepared by the following process (the steps were carried out in the order stated in the table below):

| | |
|---|---|
| Demineralized water | 47.35% |
| Gellan gum | .25 |
| Heated up to 90° C. | |
| Na citrate 2 aq | 5 |
| Sorbitol (70%) | 4.5 |
| NaOH (50%) | 1.4 |
| Cooling 50° C. | |
| Propylene glycol | 6.2 |
| LES (Manro BES 70%) | 17.5 |
| LAS (Marlon AS3) | 6.8 |
| Nonionic (Synperonic A7) | 7.0 |
| Borax (tetra di sodium borate 10 aq) | 4.0 |

After cooling the gellan gum solution remained fluid and the remaining ingredients could be easily mixed. When the same composition was prepared whereby the compound containing boron was added immediately after the cooling step and before the remaining ingredients (i.e., the propylene glycol and the surfactants), the gellan gum solution started to thicken at pH 12.

The viscosities of compositions with different gellan gum concentrations were measured at $21S^{-1}$ and 25° C.:

| Gellan gum (wt. %) | Viscosity mPA · s |
|---|---|
| 0 | 159 |
| 0.125 | 261 |
| 0.250 | 600 |
| 0.5 | 915 |

What is claimed is:

1. A highly shear thinning, transparent or translucent liquid laundry detergent composition comprising:

(a) about 0.01 to 5% by wt. of a polymer gum capable of forming stable continuous gum networks said polymer gum being xanthan, wherein said stable networks can suspend particles having size of 300 to 5000 microns;

(b) 0% to 70% by wt. nonionic surfactant;

(c) 0% to 60% by wt. of a surfactant other than nonionic (b) and selected from the group consisting of anionic, nonionic, cationic, zwitterionic/ampholytic surfactants and mixtures thereof;

wherein the combination of (b) and (c) is greater than 20%;

(d) an ingredient selected from the group consisting of an aluminum salt of a higher fatty acid, an anti-redeposition agent, and an enzyme; and (e) water;

wherein by shear thinning is meant being able to support particles 300 to 5000 microns in size while having a pour viscosity of about 50 to about 3000 cps measured at $21S^{-1}$ at about room temperature;

wherein by stable is meant particles do not phase separate for at least 2 weeks when measured at room temperature.

2. A composition according to claim 1 wherein, at a wavelength of 410–800 nanometers said composition has 50% transmittance of light using a 1 centimeter cuvette, wherein said composition is measured free of any dyes.

3. A composition according to claim 1, wherein (b) and (c) is 21% to 80% by wt.

4. A composition according to claim 1, comprising 0.1 to 10% by wt. particles having size of 300 to 5000 microns.

5. A composition according to claim 4, wherein particles are 500 to 2500 microns.

6. A composition according to claim 5, wherein particles are 700 to 2000 microns.

7. A composition according to claim 1, comprising 5% to 50% by wt. nonionic (b).

8. A composition according to claim 7, comprising 10 to 40% nonionic (b).

9. A composition according to claim 1 wherein component (c) is 1 to 35% by weight composition.

10. A composition according to claim 1, wherein pour viscosity is 100 to 2000 cps at $21S^{-1}$.

11. A composition according to claim 10, wherein pour viscosity is 150 to 1500 cps at $21S^{-1}$.

12. A highly shear thinning, transparent or translucent liquid laundry detergent composition comprising:

(a) about 0.01 to 5% by wt. of a polymer gum or polymer gums capable of forming stable non-continuous gum networks selected from the group of gums consisting of i-carrageenan, k-carrageenan, λ-carrageenan, agar, gelatin, rhamsan, gellan, and furcelleran wherein said stable networks can suspend particles having size of 300 to 5000 microns;

(b) 0% to 70% by wt. nonionic surfactant;

(c) 0% to 60% by wt. of a surfactant other than nonionic (b) and selected from the group consisting of anionic, nonionic, cationic, zwitterioniclampholytic surfactants and mixtures thereof;

wherein the combination of (b) and (c) is 15% or greater;

(d) an alkalinity buffer; and (e) water;

wherein by shear thinning is meant being able to support particles 300 to 5000 microns in size while having a pour viscosity of about 50 to about 3000 cps measured at $21S^{-1}$ at about room temperature;

wherein by stable is meant particles do not phase separate for at least 2 weeks when measured at room temperature.

13. A composition according to claim 12, wherein the polymer is gelatin.

14. A composition according to claim 12, wherein the carrageenan is kappa carrageenan.

15. A composition according to claim 14, wherein the network comprises kappa carrageenan and additionally comprises iota carrageenan.

16. A composition according to claim 14, wherein the network comprises kappa carrageenan and additionally comprises lambda carrageenan.

17. A composition according to claim 12 wherein the gel network further comprises xanthan as a thickening agent.

18. A composition according to claim 12, comprising 0.1 to 10% by wt. particles having size of 300 to 5000 microns.

19. A composition according to claim 18, wherein particles are 500 to 2500 microns.

20. A composition according to claim 19, wherein particles are 700 to 2000 microns.

21. A composition according to claim 12, comprising 5% to 50% by wt. nonionic (b).

22. A composition according to claim 21, comprising 10 to 40% nonionic (b).

23. A composition according to claim 12 wherein component (c) is 1 to 35% by weight composition.

24. A composition according to claim 12, wherein pour viscosity is 100 to 2000 cps at $21S^{-1}$.

25. A composition according to claim 24, wherein pour viscosity is 150 to 1500 cps at $21S^{-1}$.

* * * * *